US005134629A

United States Patent [19]

Cullan

[11] Patent Number: 5,134,629

[45] Date of Patent: Jul. 28, 1992

[54] INDUCTOR LOOP COATING

[75] Inventor: Gerard M. Cullan, Webster, Mass.

[73] Assignee: Norton Company, Worcester, Mass.

[21] Appl. No.: 477,290

[22] Filed: Feb. 8, 1990

[51] Int. Cl.[5] ..... H05B 6/16

[52] U.S. Cl. ..... 373/162; 373/161; 373/151; 373/152; 373/155; 373/137; 219/6.5

[58] Field of Search ..... 373/162, 161, 151, 164, 373/71, 137, 146; 219/6.5

[56] References Cited

U.S. PATENT DOCUMENTS 1,598,236 8/1926 Brayton ..... 373/162

*Primary Examiner*—Bruce A. Reynolds
*Assistant Examiner*—Tu Hoang
*Attorney, Agent, or Firm*—Arthur A. Loiselle, Jr.

[57] ABSTRACT

A high frequency core and coil electric metal melting furnace is shown. This furnace has a lined channel in its inductor for carrying the molten metal. The invention provides an improved inductor for a core and coil furnace that is not subject to leakage of the molten metal from the channel into the rammed refractory support bed for the channel which leakage otherwise shortens the lift of the furnace. Also a method of lining the channel in the inductor for carrying the molten metal which forms the core is disclosed.

16 Claims, 2 Drawing Sheets

INDUCTOR LOOP COATING

This invention relates to induction furnaces for melting metal and more particularly to an improved channel structure for a core and coil induction furnace for such a use.

BACKGROUND

The use of high frequency alternating electric current for the melting of certain metals is a well established procedure and one of these furnaces is the coreless type that has a water cooled copper tube coiled around the outside of a crucible that carries the alternating electric current, the metal to be melted being supported in the crucible that is centered within the coil. The high frequency current flowing in the cooled coil induces a current in the metal in the crucible that renders the metal molten.

Another form of an induction furnace for melting metal is a furnace that makes use of an upper case situated above an inductor that encloses a metal core with a coil positioned in the center of the core. The core stands in a vertical position and an elongated current carrying coil is centered in a horizontal position within the core. The core and its coil are embedded in a rammed granular refractory receptacle at the bottom of the furnace and a flow of an alternating electric current is induced in the core when the coil is energized that causes the core to become heated to a degree that is sufficient to melt the metal. When the furnace is in operation molten metal flows through the channel and is heated by its resistance to the flow of the induced current. The hot molten metal is collected in the upper case from which the molten metal is subsequently removed from the furnace.

When solid metal to be melted is fed into the upper case most of the heat induced in the molten metal in the core flows upwardly with the molten metal that is highly heated in the inductor, so that the solid metal is melted and the process becomes continuous, as liquid metal is poured out of the upper case's spout. The refractory receptacle itself that is carried in the inductor, which receptacle supports the channel in which the molten metal is subjected to the induced electrical current flow obviously becomes highly heated as the induction heating of the molten metal in the channel continues. In this type of melting operation it is not practical to provide any cooling means for the core and coil and thus the core or the channel in which the induced electrical current is converted to heat tends to act like a heater in the center of the receptacle.

The typical refractory receptacle used in the core and coil type of furnace is composed of refractory grains that are rammed and packed into place to form a somewhat porous receptacle that surrounds these elements to hold them in their proper relative insulated and spaced apart positions. When the coil which simulates the primary coil of an electric transformer is energized, it causes a high frequency current to flow in the metal in the core or channel which acts like the core of the transformer and a solid or molten metal in the core is heated by the alternating current flow induced therein. In this manner when the furnace is to be started up, the metal in the channel or loop of the furnace is initially heated to its melting point by the high frequency alternating current supplied to the unit and as above explained during the continued operation of the furnace the induced electrical current flow in the molten metal in the channel produces the heat that flows upwardly into the upper case with the highly heated molten stream to melt the solid metal subsequently fed into the upper case.

The core or loop of this type of furnace, is conventionally formed by molding a metal loop to shape and placing it in its solid form in a vertical position in the receptacle for the inductor with the coil disposed horizontally within the center of the loop as the refractory used for supporting the loop and coil is being rammed into place around the solid metal core and its horizontally disposed coil. When one or more of such loops and their coils have been placed in their respective positions and have been built into the rammed refractory receptacle, the furnace is fired up and as the temperature and heat build up in the core means, the solid metal melts and the molten metal then subsequently flows from the channel that has thus been formed in the receptacle by ramming the refractory grains solidly around the molded metal loop to complete the assembly. When the receptacle is being built, the loop means are held in a vertical plane and as the feeding of solid metal into the upper case proceeds and the melting process continues, the molten metal flows continuously from the channel or multiple channels left in the receptacle to carry the heat generated in the loop into the upper case. Since one or more of these loop elements may be built into the core and coil furnace and as the melting process continues more or less indefinitely it is apparent that a considerable quantity of heat is released into the refractory receptacle supporting the loop and coil and in the conventional furnace used today inevitably some molten metal leaks from the channel means to escape into the pores of the rammed refractory receptacle. This molten metal that passes into the pores of the rammed refractory body of the receptacle tends to slowly migrate deeper and deeper into the heated body of the receptacle. Ultimately the filling of the pores of the portion of the refractory receptacle surrounding the core and coil with this metal leaked from the core means destroys the ability of the inductor to serve its normal purpose to act as a support for insulating the core from the coil and for supporting and containing an established channel means within the receptacle of this type of furnace. At this point the furnace must be shut down and rebuilt before the melting processes can proceed.

It is the purpose of this invention to provide an improved core and coil type of furnace by building an improved channel structure into the furnace. The improved channel structure of this invention acts to inhibit the leakage of or infiltration of the molten metal into the porous rammed refractory receptacle that supports the core and coil elements. This improved form of loop structure is provided in order to greatly increase the life expectancy of a core and coil furnace by suppressing the leakage of molten metal from the channel or loop into the somewhat porous rammed refractory receptacle that surrounds and supports the loop and coil.

BRIEF DESCRIPTION OF THIS INVENTION

The core and coil elements built into the furnace of this invention are adapted to be supported in a rammed refractory receptacle in the same manner as have such a core and coil means always been supported in the past. In this receptacle the loop is held in a properly spaced relation to the coil, with the loop means in a vertical plane. The improved loop or channel means for establishing the channel in the refractory support for the molten metal in this furnace, however, is constructed in a manner to provide a lining throughout the channel means that results from melting the original loop structure, which lining substantially separates the molten metal in the channel from all contact with the porous refracory support for the channel. The lining within the channel is provided to contain the molten metal substantially entirely within the channel and serves to inhibit the harmful leakage of the molten metal from the channel into the slightly porous rammed refractory receptacle that surrounds and supports the channel and coil.

The liner for the channel is made of a refractory that is inert with respect to the molten metal and also substantially eliminates any leakage of molten metal from the channel into the pores of rammed refractory receptacle. The method of creating the lining and installing it in the receptacle as well as the lined channel structure itself, that is provided in this core and coil furnace, are considered to be unique in this application.

IN THE DRAWINGS

DETAILED DESCRIPTION

Figure 1:
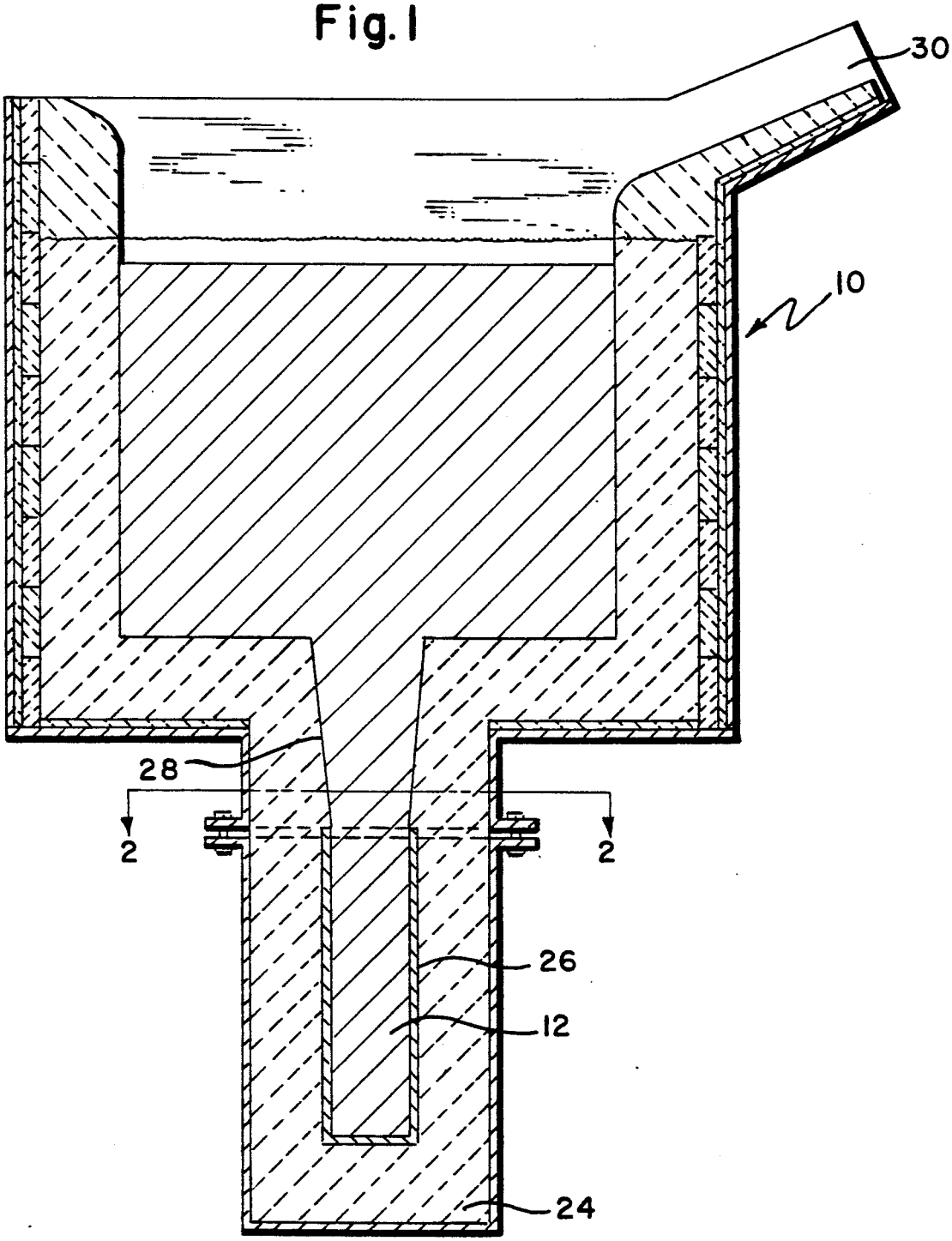
FIG. 1 is a side elevation showing the core and coil type of furnace in which the improved core of this invention is mounted.
Figure 2:
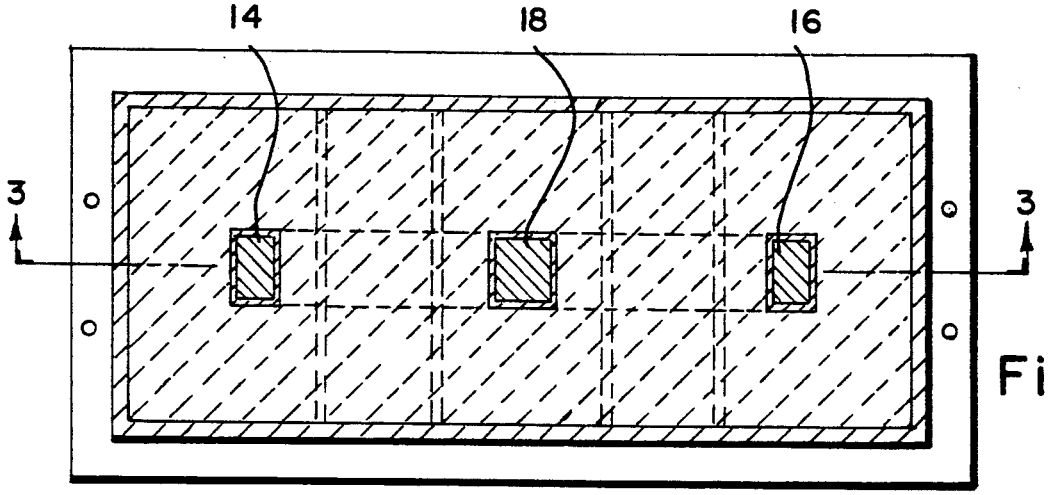
FIG. 2 is a top plan view of the inductor prior to its being assembled with the uper case after the core element has been embedded in its refractory support.

A typical core and coil high frequency metal melting furnace of this invention is shown in FIG. 1 wherein the furnace is shown having an upper case 10 and an inductor 12. The inductor as here shown has two integrated core elements 14 and 16 having a common center leg 18 installed therein as shown in FIG. 2, which core elements surround the electrical coil means 20 and 22 that includes a suitable plastic housing. The cores are metal elements that in effect are the core elements of electrical transformer means that include the coils 20 and 22 which cores become heated when a high frequency electric current is induced to flow in the core as a high frequency electric current flows through the coil when the furnace is put into operation to provide the heat for melting the metal fed into the upper case 10 of the furnace. The core means are mounted in a rammed refractory receptacle or bed 24 in a vertically disposed position and when being built into the furnace, are preferably a solid metal loop means that is adapted to surround the horizontally disposed coils positioned centrally thereof.

When the furnace is to be placed in operation, the solid metal core is heated up by a flow of an electric current that is induced therein when current flows in the coil and the solid metal of the core melts. This molten metal circulates into the upper case 10 of the furnace. As the melting process continues additional molten metal is filled into the upper case to provide a pool and more solid metal can then be fed into the pool after the process is in continuous operation. When the molten pool has been established in the upper case this pool is partly heated by a flow of induced high frequency current that results from the flow of an electric current in a conventionally used water cooled electrically conductive copper tube (not shown) fitted around the outer surface of the upper case. As the melting process continues, highly or super heated molten metal flows upwardly from the core into the upper case to melt the solid metal that has been fed into that upper case.

As indicated above, in the prior art furnaces and also in this furnace, when the furnace is being set up for a run, the solid metal core or loop means 14 and 16 as shown in FIG. 2, is held in its vertical position by the rammed refractory bed or receptacle 24 packed into place around the plastic cases of the coil means 20 and 22 and core means 14 and 16. When a high frequency eletrical current flow is initiated in the coils, a corresponding current flow is induced to flow in the core which melts this metal element and then as the furnacing process continues a thermal flow is produced in the metal in the channel that causes the molten metal to flow upwardly into the upper case through the center channel 18 of the dual core means. As explained above, it has been the experience in the past, that some of this molten metal flowing in the core, leaks outwardly and soaks into the pores of the somewhat porous rammed refractory support bed or receptacle 24 As this leakage progresses the entrapped metal solidifies in the bed 24 in a manner that tends to slowly deactivate the furnace.

While it is not intended as a limitation in connection with this invention, it is can be established that in the prior art furnacing operations, as this melting process continued, some small amounts of silica and lime impurities such as are nearly always present in the commercial metal infeed, was entrained in the metal fed to the furnaces, and these impurities passed into the inductor channel means. When the silica and lime came in contact with the slightly porous rammed refractory support that supported the coil and defined the channel for the molten metal, these impurities together with any other oxides of the molten metal, formed an oxide front precursor. This precursor component in contact with the porous surface of the rammed refractory is believed to effect the contact wetting angle of the refractory. This layer in effect becomes a wetting agent which tends to encourage the leakage of the molten metal into the pores of the rammed refractory material. As the oxide precursor flows into the refractory support, the molten metal follows it until such an isotherm is reached that the metal is cooled below its solidus. At this point, further metal penetration into the refractory ceases until a further increase in the heat energy input results in melting the metal and oxide front. It has been observed that such intrusion of the oxide and metal into the porous refractory prevents the ultimate maturing of the ceramic refractory immediately surrounding the molten metal in the channel formed in the inductor.

Without going into the analyses made to substantiate this activity, it can be positively established that the rammed refractory adjacent the channel was heavily infiltrated with metal for about one-third of the distance from the hot face at the channel out toward the cooler exterior wall and the refractory composition of the rammed refractory was somewhat altered. An intermediate or central zone can be seen that is also highly infiltrated with metal which was found to be detrimental to some extent with the bonding of the porous refractory support. The outer one-third of the refractory in the inductor seemed to be fairly clean and well bonded.

In order to overcome the metal infiltration from the core into the rammed refractory, as taught herein, a core and coil induction furnace is built in the same manner as the furnaces of the prior art in that a solid metal loop means 14 and 16 is mounted in a vertical position in the rammed refractory bed 24 with the cooperating coil means 20 and 22 supported horizontally in the center thereof. The loop means about which the refractory is packed in this invention differs from the prior art, however, in that a casting in the form of the solid metal loop or a hollow metal shape is coated with a thin refractory coating 26 prior to being installed in the refractory receptacle.

Figure 3:
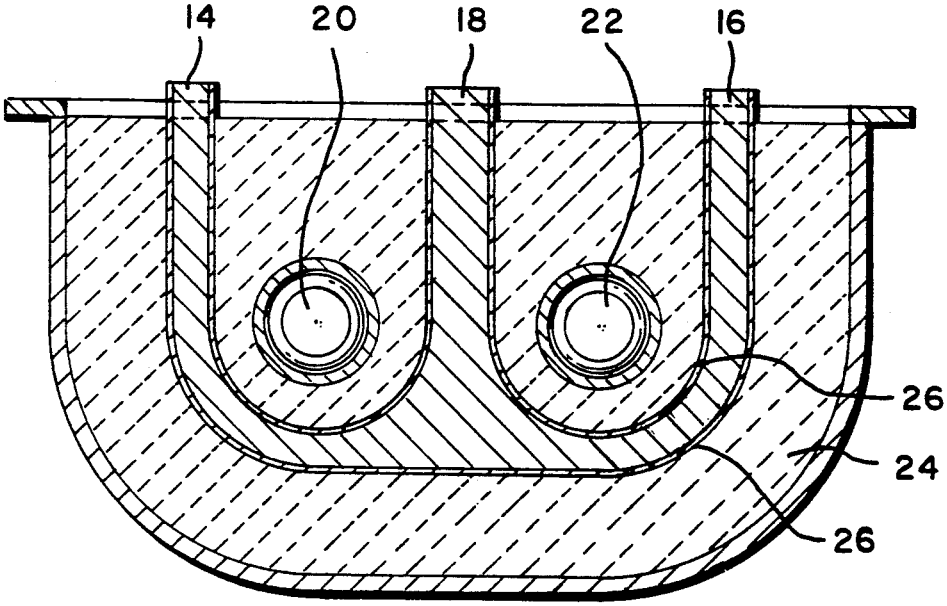
FIG. 3 is a front sectional elevation of the loop means taken on line 3—3 of FIG. 2. of this invention.

In the preferred form of this invention the loop means 14, 16 and 18 for example that is shown standing alone in FIG. 3, which forms the core element of this furnace, is first formed preferably as a solid metal shape that is made from the metal that is to be melted in the furnace. The solid loop is coated with a thin impervious refractory layer 26 which coating has a melting point well above that of the metal to be melted in the furnace. The coating 26 is preferably formed from a sprayed on molten refractory that is frozen in situ on the surface of the solid core. Such a refractory coating may be applied to the core's surface with a plasma arc spraying process or with the Rokide (TM of Norton Co.) process or any equivalent method that produces a thin coherent substantially non-porous preferably a refractory coating on the surface of the solid molded metal core shape.

A coated loop constructed as described and shown in FIG. 3, is a rigid self sustaining loop, that is adapted to be packed in the inductor or lower case 12 in the rammed granular refractory bed 24. When the solid loop or loops and their respective coils are properly positioned in the inductor and the conventional granular refractory packing 24 has been rammed around the loop and coil means, the inductor is coupled to the water cooled upper case 10 with the installation of an intermediate throat element 28 that connects the upper end of the legs of the channel means 14, 16, and 18 with the interior of the upper case. Then the upper case insulating wall means of the convention design of a core and coil furnace is built in around the throat and within the wall of the upper case. When this structure has been completed, the furnace can be readied for its start up.

When high frequency current is turned on and the coil induces a current to flow in the core means 14, 16 and 18, the furnace begins to operate in the known manner. As the heat builds up from the action of the induced electrical current flow in the core, the temperature in the core rises until the solid metal of the loop means melts. During the start up operations the upper case is filled with molten metal supplied from an outside source and as the metal in the core is heated by the continued flow of the electric current induced to flow in the core, the molten metal in the core becomes highly heated and a thermal flow of the thusly heated molten metal from the central leg 18 of the dual core means here shown into the upper case occurs and other molten metal flows into the outside legs of the core or channel in the inductor to become more highly heated. After the thermal flow pattern in the molten metal has been established, additional metal in solid form may be fed into the upper case to be melted . From time to time molten metal is poured from the upper case through the spout 30 when the furnace is tipped or other means may be provided to skim off some of the melted metal.

It is to be observed that upon starting up the furnace, as the solid metal of the loop means is initially melted the refractory coating 26 that had been sprayed in molten form and frozen in situ on its surface, remains embedded in the rammed refractory receptacle or bed 24 of the furnace. The coating 26 that remains in the rammed refractory bed 24 now forms a lining that defines the flow channel for directing the flow of the molten metal that now constitutes the substance that is the core of the furnace, as best seen in FIG. 2. This lining forms a layer for establishing the flow channel, which layer or lining is made from a refractory that remains a solid at the temperature produced in the channel for melting the metal and containing the molten metal, and the refractory coating is selected to be inert with respect to the metal being melted and is substantially impervious to the leakage of molten metal from the channel into the pores of the ranmed refractory bed 24.

The coating 26 is preferably applied to the solid loop means as a molten spray that is then solidified in situ on the surface of this metal form. The use of a plasma spray or Rockide method of coating the loop has been mentioned above. Any equivalent procedure can be utilized for coating the loop means with a refractory layer as long as an inert coating is formed on the loop's surface, which coating when solidified forms a relatively nonporous layer and which will not melt at the temperatures produced in the furnace and is operative to preclude the leakage of molten metal from the channel means 14, 16 and 18 into the porous surrounding rammed refractory bed 24 in the inductor or lower case 12. Such leakage has in the past been found to be objectionable when the leakage continued to such an extent as to render the furnace inoperative.

The refractory selected for the coating 26 should have a relatively high melting point and as above stated, be substantially inert with respect to the molten metal flowing in the channel of the furnace. It is of course essential to the proper functioning of the ultimate coating formed on the loop for deposition in the bed as a liner for the channel upon the melting of the solid metal in the loop, that the coating be substantially self sustaining and impervious to the leakage of molten metal from the channel into the pores of the bed. Alumina, chromia, magnesia, zirconia and some spinels, have been found to be very satisfactory for this purpose depending upon the metal or metal alloy to be melted.

The rammed refractory used for the bed 24 that supports the core and coil elements is usually one selected from a granular supply of a mullite bonded alumina, spinel bonded alumina, and a spinel bonded magnesia. All of these materials when rammed into place have an approximate 18% open porosity with a mean pore radius of approximately 10 um. The sprayed on refractory coatings that have been described above have an open porosity of approximately 0.5, with a mean pore radius in the angstrom range. Any of the proposed coatings may be fused and sprayed onto the loop means used for this purpose and will subsequently become bonded to any of the three named major refractory types of grains used for ramming to form the bed for the channel means of this furnace. The actual choice of coatings is based on the alloy chemistry of the melt, temperature of the melt, power level of the furnace, use in the upper case 10 of either a conventional air or water cooled furnace bushing, and the clogging/erosion tendency of the inductor 12.

The coated loop of this invention can be made in the form of any conventional channel shape. The known molded shapes of solid or hollow metal forms can easily be successfully coated with a refractory spray coating as suggested above and such coated loop means will be found to serve as a carrier for the liner 26 which constitutes the wall or liner of the channel for the molten metal during the operation of the conventional core and coil furnace as taught herein. It is not essential that the metal of the loop be the same metal as that to be melted in the furnace, but, preferably, to avoid contamination of the ultimate product, the loop should be cast or otherwise formed of the same metal as that to be melted. Any material that can be coated with an impervious coating as described above, and which can be eliminated by the heat induced in the core by a high frequency electric current flow in the coil of the furnace, and that can be formed into the shape of the desired channel, can be used for this purpose. Any such rigid shape that can be coated with an inert and impervious and preferably refractory layer could be used for the initial coated form of loop means adapted to be packed in the rammed refractory receptacle in the inductor or lower case 12 to form the channel described herein.

While the above is a description of the preferred form of this invention, it is possible that modifications thereof may occur to those skilled in the art that will fall within the scope of the following claims.

I claim:

1. A method for building a core element and coil type of induction heated metal melting furnace having a channel filled with metal that surrounds the coil and forms the core element in an inductor of the furnace, the core element being embedded in a porous refractory receptacle formed by a refractory ramming process comprising the steps of forming a rigid loop shaped element that defines a space to be filled with molten metal that constitutes the core element of the furnace, coating said loop shaped element with a coherent layer that is relatively inert with respect to and substantially impervious to an escape of said metal being melted from said channel when it is in a molten state, embedding said coated loop shaped element in said rammed refractory receptacle of the furnace, and then energizing said coil in the inductor of the furnace to heat the metal in said core element to melt said coated loop shaped element whereby to leave said coating as a deposited lining for said channel in the rammed refractory receptacle, said lining serving to inhibit a leakage of molten metal from said channel into said porous rammed refractory receptacle.

2. A method as in claim 1 wherein said loop shaped element is formed as a solid metal in a shape of said channel.

3. A method as in claim 1 wherein said coating is sprayed in a molten form onto said loop shaped element when said core element is in solid form, and then solidifying said coating in place.

4. A method as in claim 3 wherein said loop shaped element is formed as a solid metal in a shape of said channel.

5. A method as in one of claims 3 or 4, wherein said spraying step is a plasma sprayed coating.

6. A metal melting furnace wherein a loop shaped means is provided for building a channel for containing molten metal in an inductor element of a core and coil induction furnace, said furnace having an upper case for cooperating with said inductor element, said channel is filled with molten metal constituting the core of said furnace, said channel being supported in a rammed granular refractory bed in said inductor element and having an open top through which molten metal flows from said channel into said upper case, said loop shaped means comprising a solid metal loop having a shape of the channel to be embedded in said rammed granular refractory bed, said solid metal loop being covered on all sides except for its top side with a thin rigid coating, said thin rigid coating being formed of a material that is inert with respect to, the metal being melted, and said thin rigid coating being impervious to a leakage of the molten metal from the channel, said embedded solid metal loop being supported in said rammed granular refractory bed with its top exposed upwardly facing said upper case so that when the furnace is started up the solid metal loop is melted to permit the molten metal to flow into the upper case through the channel provided by said rigid coating that is embedded in the rammed granular refractory bed.

7. In a core and coil type of an induction metal melting furnace having a metal filled channel in an inductor for containing the metal being melted and which metal in the metal filled channel forms said core and surrounds the coil of the furnace, both of which channel and coil are embedded in a rammed granular refractory supporting means in the inductor of the furnace, the metal filled channel comprising a passageway for containing the metal to be melted, a lining for said passageway, said lining being a refractory material inert with respect to the molten metal and selected from the group of refractories consisting of alumina, zirconia, chromia, magnesia and spinels, and said lining being substantially impervious to a leakage of the molten metal from said channel into the rammed refractory supporting means of the furnace.

8. A lining as set forth in claim 7 wherein said lining is formed from one of said refractories which is melted and formed into said lining.

9. A core and coil type of induction furnace for melting metal that includes an inductor means including a rammed granular refractory support in a receptacle, said refractory support supporting said core which takes a form of a metal filled channel, said channel having wall means for containing the metal that is being melted, said core surrounding the coil of the furnace, both of said core and coil being embedded in a spaced relationship within said rammed granular refractory support in said receptacle, said wall means of said channel comprising a lining for said channel that inhibits the molten metal from leaking through the lining to infiltrate into the rammed granular refractory support in said receptacle, said lining forming a continuous refractory wall for defining said channel, said wall being formed of a refractory that is inert with respect to the metal being melted, and said lining being substantially impervious to said molten metal.

10. A core and coil type of high frequency induction type of metal melting furnace having an inductor for containing a core, which inductor contains a rammed refractory bed that surrounds the core and coil, the core initially being a rigid element carrying a coating, which rigid element is eliminated when the coil is energized so that said coating remains and forms a wall for defining a channel for a flow of a molten metal through the inductor of the furnace, said coating being comprised of a thin refractory layer forming said wall for said channel that separates the molten metal from the rammed refractory bed of the inductor and wherein said coating that constitutes said wall is inert with respect to the metal being melted, and said wall being substantially impervious to a leakage of molten metal through the wall into the rammed refractory bed.

11. A core and coil type as in claim 10 wherein said coating is a refractory layer that is sintered in place as metal is melted in said inductor whereby to integrate the wall with the rammed refractory bed supported in the inductor to form a channel for the molten metal.

12. A core and coil type as in claim 10 wherein the wall is formed of a refractory selected from the group of refractories consisting of alumina, zirconia chromia, magnesia, and spinels.

13. A core and coil type as in claim 10 wherein said wall is a fusion sprayed refractory that surrounds said molten metal.

14. A core and col type as in claim 10 wherein said wall is a plasma sprayed coating onto said core before it is embedded in said rammed refractory bed.

15. A core and coil type as in claim 10 wherein said wall is a plasma sprayed coating that has been applied to said core prior to its being embedded in said rammed refractory bed.

16. A coil and coil type as in one of claims 10, 11, 12, 13, 14, or 15, wherein said wall is sintered in place in said rammed refractory bed.

* * * * *